United States Patent [19]

Staufer et al.

[11] 3,997,187

[45] Dec. 14, 1976

[54] SNOW SKI HAVING FRONT TIP WITH PARALLEL SIDES

[75] Inventors: Adolf Staufer, Ried; Georg Altenburg, Andrichsfurt, both of Austria

[73] Assignee: Fischer Gesellschaft m.b.H., Innkreis, Austria

[22] Filed: Feb. 19, 1975

[21] Appl. No.: 550,939

[30] Foreign Application Priority Data

Feb. 21, 1974 Austria ..... 1420/74

[52] U.S. Cl. ..... 280/609

[51] Int. Cl.[2] ..... A63C 5/00

[58] Field of Search ..... 280/11.13 S, 11.13 L, 280/11.13 K, 11.13 M, 11.13 A, 11.13 F, 11.13 H, 11.13 R, 28, 12 H, 609, 12 K, 12 KL, 21 A, 600, 601, 602, 603, 606, 607

[56] References Cited

UNITED STATES PATENTS

| | | | |
|---|---|---|---|
| 2,242,156 | 5/1941 | Wallace | 280/11.13 M |
| 2,510,794 | 6/1950 | Beerli | 280/11.13 S |
| 2,694,580 | 11/1954 | Head | 280/11.13 L |
| 2,926,364 | 3/1960 | Cox | 280/11.13 M |
| 3,295,859 | 1/1967 | Perry | 280/11.13 M |

FOREIGN PATENTS OR APPLICATIONS

| | | | |
|---|---|---|---|
| 218,411 | 11/1961 | Austria | 280/602 |

*Primary Examiner*—M. H. Wood, Jr.
*Assistant Examiner*—Milton L. Smith
*Attorney, Agent, or Firm*—Imirie, Smiley & Linn

[57] ABSTRACT

A ski comprising an elongated body having a leading end portion which terminates in an upwardly curved scoop. The scoop has a rounded end, which is tapered in width and has a length of up to 90 mm, and a succeeding portion which has parallel side faces.

2 Claims, 3 Drawing Figures

SNOW SKI HAVING FRONT TIP WITH PARALLEL SIDES

SUMMARY OF THE INVENTION

A ski comprising an upwardly curved scoop, which has a rounded end portion and a succeeding scoop portion formed with parallel side faces.

BACKGROUND OF THE INVENTION

Known skis have an upwardly curved leading end portion referred to as a scoop. Throughout its length, which is, on an average, in excess of 150 mm, this scoop tapers in width toward the leading end of the ski or tip of the scoop. The steel edges of the tread extend along the entire surface which contacts the snow and also along part of the upwardly curved scoop, which is tapered in width. Owing to this taper in width and the upward curvature of the scoop, the steel edge on each side of the ski has a double curvature. When the skis are closely spaced during skiing, the steel edge of one ski may contact the top edge of the tapered scoop of the other ski and may thus be caught.

It is an object of the invention to provide a specially shaped scoop which has a smaller tendency to displace snow than the scoops of known skis so that the ski exhibits an improved performance particularly during skiing in deep snow.

A further object of the invention is to provide the scoop end portion with an edge having a specially designed curvature so that the performance of the ski is further improved in the sense stated above.

Further details of the invention will be explained with reference to the drawings, which show embodiments of a known pair of skis and of a pair of skis according to the invention.

DETAILED DESCRIPTION OF THE INVENTION

Figure 1:
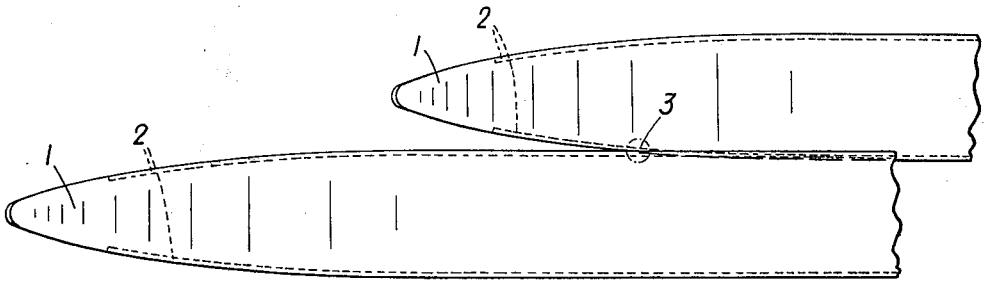
FIG. 1 is a plan view which shows the scoops of a known pair of skis in a position in which the skis may cross each other.

FIG. 1 shows skis of known type having a scoop 1, which is tapered in width and terminates in a pointed tip and is rounded only at the sides as required during manufacture. The tapered portion has a length of about 150 mm or more and is curved upwardly throughout its length. Steel edges 2 are received in the tread along both edges thereof and extend also along part of the sides of the scoop 1. Because the entire scoop is tapered in width, the edges 2 must be curved upwardly and toward the center line of the ski. Particularly with profiled edges, such as angle-section edges, this bending in two different senses is undesirable. This known ski has a portion 3 at which the skis can cross each other, as mentioned above.

Figure 2:
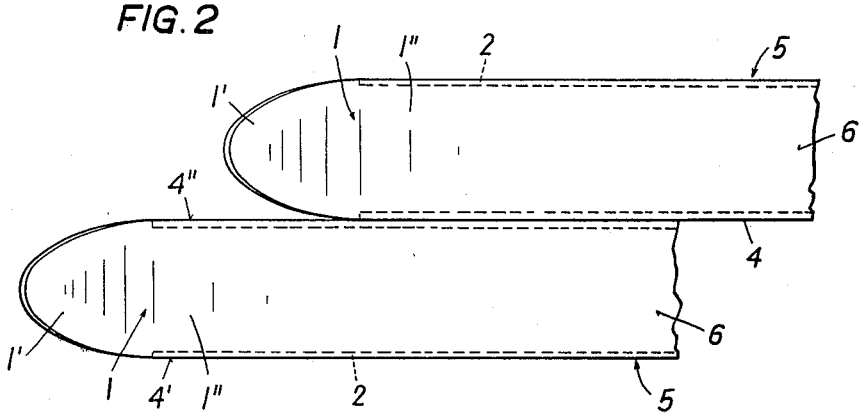
FIG. 2 is a plan view which shows the corresponding end portions of a pair of skis according to the present invention in the same position.
Figure 3:
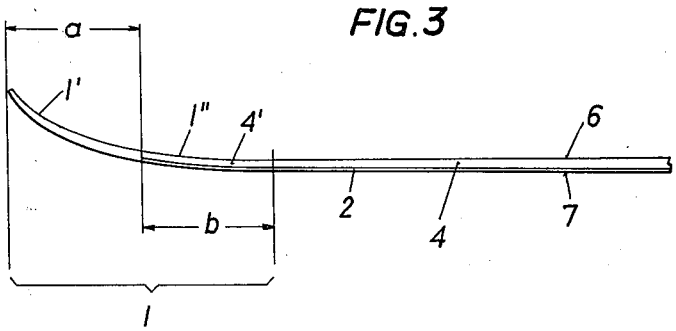
FIG. 3 is a side elevational view showing the end scoop of the ski according to the invention.

Like the known ski, the ski according to the invention, shown in FIGS. 2 and 3, has an elongated body portion 5, which has a top surface 6, a bottom surface 7, and side faces 4. At its leading end, the body portion 5 is continued by an upwardly curved scoop 1, which differs from the known scoop in that it is tapered in width only in its portion 1' next to the tip.

In the scoop according to the invention, the tapered portion 1' has a length *a* of about 90 mm or less. The rearwardly succeeding portion 1'' of the scoop 1 has a length *b* and is formed with side faces 4', 4'' that are parallel as far as to the leading end of that portion of the ski which tapers to the so-called telemark shape. In this scoop portion 1'' the side faces 4', 4'' of the upwardly curved scoop 1 lie in a plane which extends vertically and in the skiing direction so that the skis cannot cross and the steel edge cannot be caught. The scoop has a larger drag-producing area facing in the direction of the longitudinal axis of the ski so that its tendency to displace snow is reduced.

In conjunction with the upward curvature of the scoop, this results during skiing in deep snow in an increased uplift, which prevents a subsiding of the scoop. The larger drag-producing area of the scoop according to the invention, compared to the conventional ski, results in an improved performance of the ski during skiing in deep snow even if the height of the scoop is not increased.

In this ski the steel edges 2 extend only as far as to the rear end of the tapered portion of the scoop, i.e., only along the portion 1'' of the scoop, so that the steel edge must be curved only upwardly and need no longer be curved toward the center line of the ski.

The curvature at the end tip of the scoop is approximately constant along an arc having an average radius of curvature of 20 mm to preferably 25 mm. At the transition from the tapered portion 1' of the scoop 1 to that portion 1'' thereof which has parallel side faces 4', 4'', this radius of curvature increases continuously to infinity.

What is claimed is:

1. A snow ski comprising an elongated body which is defined by a top surface, a bottom tread surface provided at its sides with steel edges, and side faces, said body having at its leading end an upwardly curved solid scoop having a rounded peripheral tip portion, which is tapered in width and curved according to a continuous arc having an average radius of 20–25 mm, said arc merging continuously into a scoop root portion which has parallel side faces.

2. A snow ski according to claim 1, wherein the steel edges extend only as far as to the tapered portion of said scoop and are curved upwardly only to conform to the curvature of said scoop root portion.

* * * * *